US011090923B2

(12) United States Patent
Muraoka

(10) Patent No.: US 11,090,923 B2
(45) Date of Patent: Aug. 17, 2021

(54) OFFSET PRINTING METHOD

(71) Applicant: SHUHOU CO., LTD., Fukui (JP)

(72) Inventor: Kouji Muraoka, Fukui (JP)

(73) Assignee: SHUHOU CO., LTD., Fukui (JP)

( * ) Notice: Subject to any disclaimer, the term of this patent is extended or adjusted under 35 U.S.C. 154(b) by 0 days.

(21) Appl. No.: 16/624,732

(22) PCT Filed: Jun. 20, 2017

(86) PCT No.: PCT/JP2017/022702
§ 371 (c)(1),
(2) Date: Dec. 19, 2019

(87) PCT Pub. No.: WO2018/235165
PCT Pub. Date: Dec. 27, 2018

(65) Prior Publication Data

US 2020/0215815 A1 Jul. 9, 2020

(51) Int. Cl.
*B41J 2/01* (2006.01)
*B41F 17/30* (2006.01)

(52) U.S. Cl.
CPC ..... *B41J 2/01* (2013.01); *B41F 17/30* (2013.01)

(58) Field of Classification Search
CPC ... B41J 2/01; B41J 2/211; B41J 2/1433; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 2/1623; B41J 2202/00; B41J 2202/03; B41J 2/14201; B41J 2/045; B41J 11/0015;
(Continued)

(56) References Cited

U.S. PATENT DOCUMENTS 4,798,136 A 1/1989 Henze et al.
5,854,642 A 12/1998 Takahashi et al.
(Continued)

FOREIGN PATENT DOCUMENTS

CN 103459160 A 12/2013
CN 103796838 A 5/2014
(Continued)

OTHER PUBLICATIONS

International Search Report (ISR) with an English translation and Written Opinion (WO) dated Aug. 8, 2017 for Application No. PCT/JP2017/022702.
(Continued)

*Primary Examiner* — Manish S Shah
(74) *Attorney, Agent, or Firm* — Ladas & Parry LLP

(57) ABSTRACT

An offset printing method is provided that, while using an ink with a viscosity that allows for printing of a print image on a printing plate by an ink-jet process, enables a precise print image to be transferred from the printing plate to a print medium by use of a printing blanket. The offset printing method includes a printing-plate making step of printing an inked image on a printing plate by an ink-jet process, an ink drying step of evaporating a solvent contained in the ink of the inked image to increase the viscosity of the ink, a transferring step of transferring the inked image to the surface of a printing blanket, and a printing step of pressing the printing blanket against a print medium.

12 Claims, 4 Drawing Sheets

(58) Field of Classification Search
CPC ..... B41J 11/002; B41J 2/04581; B41J 2/055; B41J 2/16538; B41J 2002/16502
See application file for complete search history.

(56) References Cited

U.S. PATENT DOCUMENTS

| | | | | |
|---|---|---|---|---|
| 9,533,491 | B1 | 1/2017 | LeFevre et al. | |
| 2009/0207198 | A1 | 8/2009 | Muraoka | |
| 2014/0015908 | A1 | 1/2014 | Ohnishi | |
| 2014/0092168 | A1* | 4/2014 | Ito | B41J 2/16552 347/21 |
| 2015/0097906 | A1* | 4/2015 | Beier | B41J 11/002 347/103 |
| 2016/0001577 | A1 | 1/2016 | Kodama | |

FOREIGN PATENT DOCUMENTS

| | | | |
|---|---|---|---|
| CN | 104540682 | A | 4/2015 |
| CN | 104661825 | A | 8/2015 |
| CN | 110770034 | A | 2/2020 |
| EP | 2756959 | A1 | 7/2014 |
| JP | 2008183846 | A | 8/1908 |
| JP | H10202996 | A | 8/1996 |
| JP | 2006130725 | A | 5/2006 |
| JP | 2009238709 | A | 10/2009 |
| JP | 2012214009 | A | 11/2012 |
| KR | 1019840004385 | A | 10/1984 |
| KR | 101995000550 | A | 3/1995 |
| KR | 1020030096012 | A | 12/2003 |
| KR | 1020100105017 | A | 9/2010 |
| KR | 1020150120478 | A | 10/2015 |

OTHER PUBLICATIONS

Extended European Search Report dated Dec. 23, 2020 for Application No. EP 17914561.0.
Chinese Office Action with an English translation dated Dec. 23, 2020 for Application No. CN 201780092394.X.
Korean Office Action with an English translation dated Oct. 30, 2020 for Application No. KR 10-2019-7033405.
Japanese Office Action with an English translation dated Nov. 10, 2020 for Application No. JP 2019-524750.
Japanese office action with an English translation dated May 11, 2021 for Application No. JP 2019-524750.
Korean office action with an English translation dated May 24, 2021 for Application No. KR 10-2019-7033405.
The neighbor blog3-4-1 prints drying, [on line], and Sep. 28, 2006., [May 21, 2021 search] < https: // blog naver.com. / chemeerwoo / 130009288027, pp. 1-3.
Chinese office action with an English translation, dated Jun. 15, 2021 in connection with corresponding Chinese Patent Application No. CN 201780092394.X.

* cited by examiner

OFFSET PRINTING METHOD

RELATED APPLICATION

This application is an application under 35 U.S.C. 371 of International Application No. PCT/JP2017/022702 filed on Jun. 20, 2017, the entire contents of which are incorporated herein by reference.

TECHNICAL FIELD

The present invention relates to an offset printing method, in particular, a printing method using an ink-jet process.

BACKGROUND ART

Conventional offset printing methods use a printing blanket to perform printing as follows. The blanket is pressed against a printing plate having ink placed thereon in a pattern corresponding to an intended print pattern, thus transferring the ink in the shape of the print pattern to the printing blanket. Subsequently, the ink transferred to the printing blanket is transferred to a printing surface on which to print the print pattern, by pressing the printing blanket against the printing surface. The print pattern is thus printed on the printing surface.

The following method is now being used in offset printing to enable printing of a precise image or other information. The method includes printing a print image on a printing plate by an ink-jet process, transferring the print image on the printing plate to a printing blanket, and pressing the printing blanket against a print medium on which to print the print image, thus printing the print image on the print medium. To enable printing on the printing plate by an ink-jet process, ink having a low viscosity is used. Ultraviolet (UV)-curable ink is used as this ink. Prior to transferring the print image to the printing blanket, the UV-curable ink on the printing plate is semi-cured by ultraviolet irradiation. This ensures that the ink deposited on the printing plate and forming the print image does not collapse upon transferring the print image to the printing blanket (see, for example, Patent Literature 1).

CITATION LIST

Patent Literature

Patent Literature 1: Japanese Unexamined Patent Application Publication No. 2006-130725

SUMMARY OF INVENTION

Technical Problem

The invention disclosed in Patent Literature 1 uses UV ink as printing ink. The UV ink on the printing plate is semi-cured by ultraviolet irradiation. A problem with this approach is that it is difficult to adjust the UV ink to an appropriate viscosity by adjusting the condition for ultraviolet irradiation. To enable transfer of the UV ink from the printing plate to the printing blanket, the UV ink needs to be adjusted to a viscosity that at least allows the UV ink to adhere to the surface of the printing blanket without completely curing the UV ink. If, for instance, the amount of energy is not uniform across the entire beam diameter of the applied ultraviolet light, and the print image on the printing plate has a large size, it is difficult to make the amount of energy of ultraviolet light uniform across the entire print image. In a curing process by UV irradiation, polymerization is initiated as radicals (active species) generated by a photoinitiator contained in UV ink react with reactive groups in monomers or oligomers. Consequently, how the UV ink cures also varies with the composition of the UV ink. It is thus difficult to semi-cure the UV ink on the printing plate to a desired viscosity by ultraviolet irradiation.

The present invention has been made to address the above-mentioned problem. Accordingly, it is an object of the present invention to provide an offset printing method that, while using an ink with a viscosity that allows for printing of a print image on a printing plate by an ink-jet process, enables a precise print image to be transferred from the printing plate to a print medium by use of a printing blanket.

Solution to Problem

An offset printing method according to an embodiment of the present invention includes a printing-plate making step of printing an inked image on a printing plate by an ink-jet process, an ink drying step of evaporating a solvent contained in the ink of the inked image to increase the viscosity of the ink, a transferring step of transferring the inked image to the surface of a printing blanket, and a printing step of pressing the printing blanket against a print medium.

Advantageous Effects of Invention

The offset printing method according to an embodiment of the present invention enables full-color (multi-color) printing on a printing plate to be performed in a single process by ink-jet printing without the need to replace the printing plate, and also enables printing of a precise inked image. The offset printing method also allows the ink on the printing plate to be adjusted to a viscosity required for transferring the ink to a printing blanket. This enables offset printing with a precise inked image by use of the printing blanket.

DESCRIPTION OF EMBODIMENTS

Embodiment 1

Figure 1:
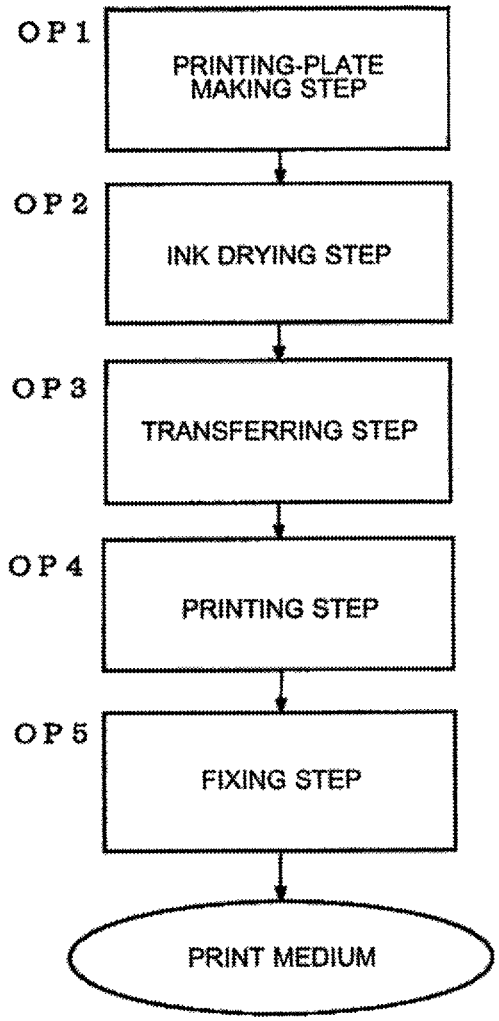
FIG. 1 is a process flowchart illustrating an offset printing method according to Embodiment 1 of the present invention.
Figure 2:
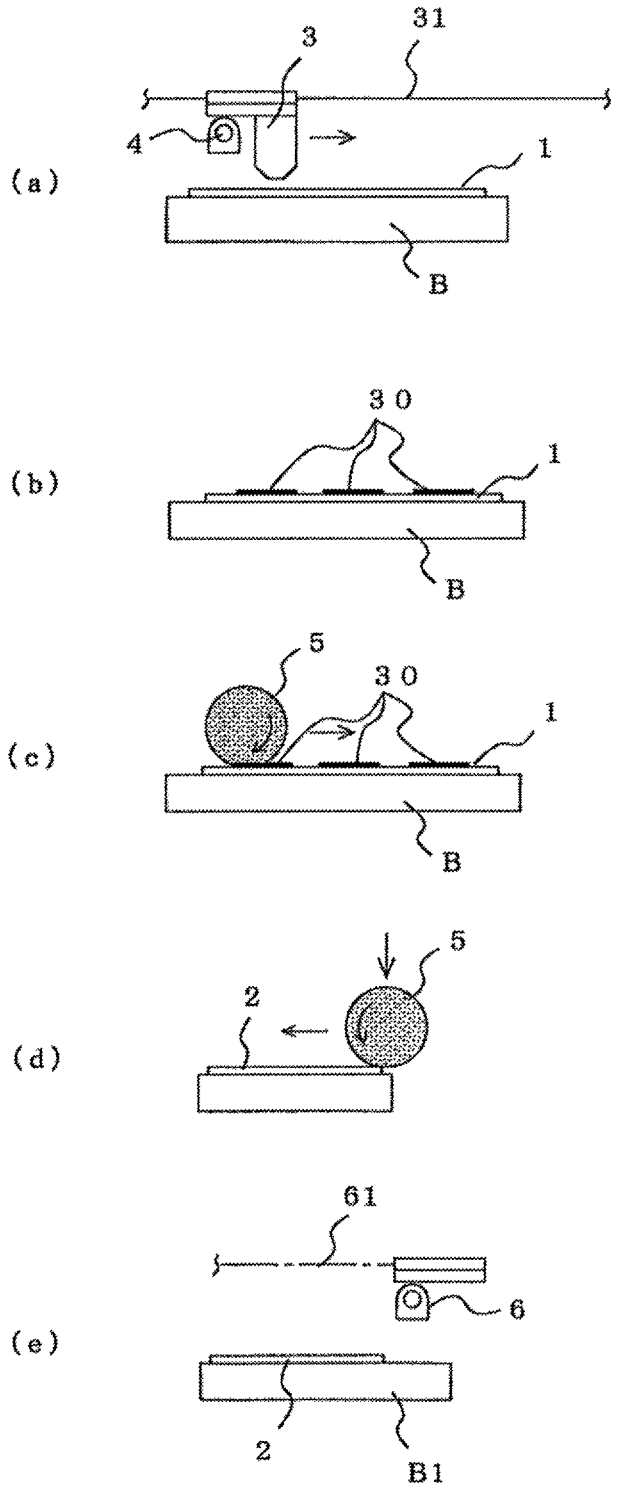
FIG. 2 explains steps illustrated in FIG. 1.
Figure 3:
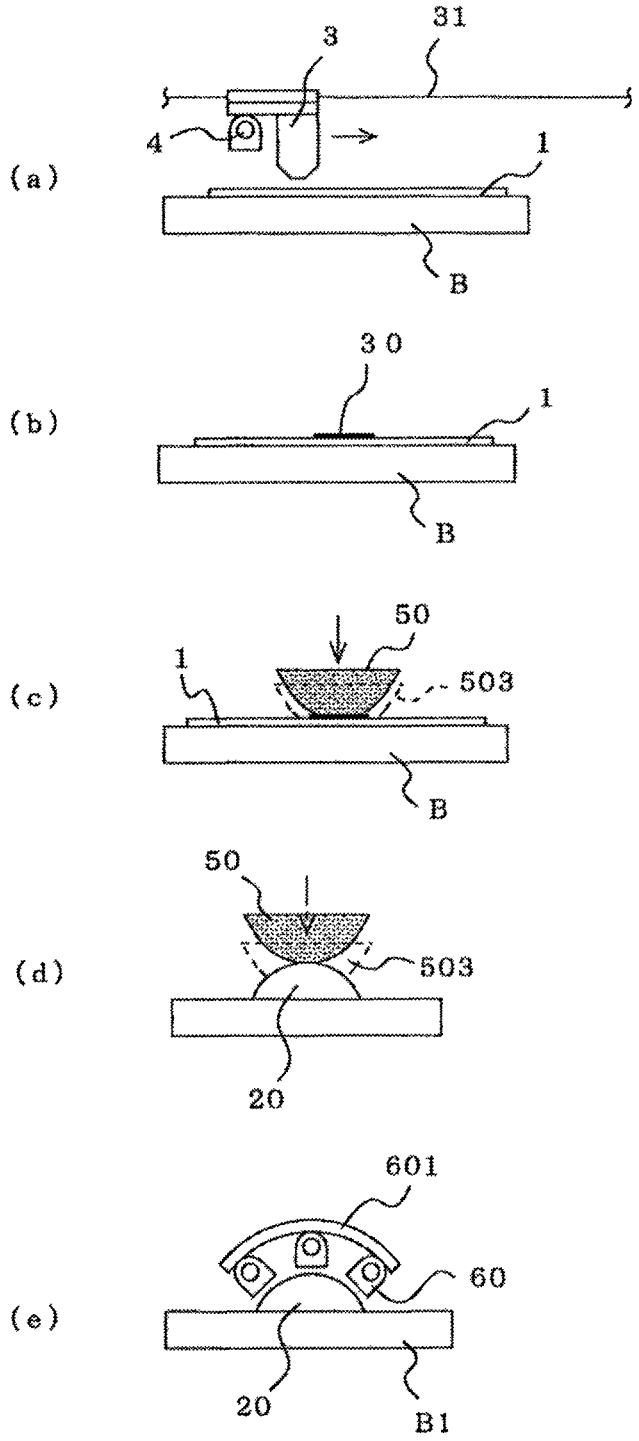
FIG. 3 explains steps illustrated in FIG. 1.

FIG. 1 is a process flowchart illustrating an offset printing method according to Embodiment 1 of the present invention. FIGS. 2 and 3 each explain steps illustrated in FIG. 1. FIG. 2 illustrates a case in which a printing blanket 5 having a cylindrical shape is used. FIG. 3 illustrates a case in which the printing blanket used is a printing blanket 50 that is semi-spherical or a semi-cylindrical, or has a curved surface such as a parabolic surface.

Reference sign OP1 denotes a printing-plate making step in which an inked image is printed on a printing plate 1 by an ink-jet process. Reference sign OP2 denotes an ink drying step in which, while an image is printed on the printing plate 1 in OP1 or immediately after an image is printed on the printing plate 1 in OP1, an ink 30 constituting the print image is semi-dried (semi-cured). Reference sign OP3 denotes a transferring step in which the print image in a semi-dry (semi-cured) state produced on the printing plate 1 is transferred to the printing blanket 5 or 50. Reference sign OP4 denotes a printing step in which the printing blanket 5 or 50 having the print image transferred thereto is moved to print the image on a print medium 2 or 20. Reference Sign OP5 denotes a fixing step in which the print image on the print medium 2 or 20 produced by offset printing is fixed onto the print medium 2 or 20.

(Printing-Plate Making Step OP1)

As illustrated in FIG. 2(*a*), the printing plate 1, which has a flat shape, is placed on a setting base B. Although the printing plate 1 is a thin flat plate made of an aluminum alloy in the present example, the printing plate 1 used may be a sheet member called "receptor sheet" having superior retention and affinity for UV ink. A sheet member may be provided with irregularities to provide improved retention and affinity for ink. The surface of the printing plate 1 is finished to a surface roughness ranging from, for example, 2 μm to 10 μm. An ink-jet printing device 3 can be moved by a feeding device (not illustrated) in the horizontal direction at least above the printing plate 1. Alternatively, the printing plate 1 may be movable relative to the ink-jet printing device 3. The ink-jet printing device 3 creates an image under control by a computer. As illustrated in FIG. 3(*a*), the printing-plate making step OP1 is performed in the same manner as mentioned above also in the case of offset printing on the print medium 20 having a curved surface. With printing by an ink-jet process, fine droplets of ink are discharged from a nozzle and blown onto the printing plate 1 to obtain a print image. Accordingly, the ink 30 used is an ink having a colorant, a monomer, synthetic resin, a dispersant, a photopolymer, a photoinitiator, and other materials that are dispersed under stirring in a solvent. The proportion of the solvent in the ink 30 is adjusted as appropriate such that, in performing printing by an ink-jet process, the ink 30 is adjusted to a viscosity ranging from 1 mP (poise) to 10 mP (poise). More desirably, the ink 30 may be adjusted to a viscosity ranging from, for example, 5.0 mP to 7.0 mP. Printing by an ink-jet process can be performed by using the ink 30 with a viscosity of up to 1.0 P (poise).

(Ink Drying Step OP2)

At the end of the printing-plate making step OP1, the ink 30 on the printing plate 1 has a low viscosity. If the viscosity of the ink 30 on the printing plate 1 remains low, the ink 30 on the printing plate 1 collapses upon pressing the printing blanket 5 or 50 against the ink 30. The ink 30 is thus not transferred with precision. A low viscosity of the ink 30 also leads to reduced precision of the print image due to spreading of the ink 30 or other causes. Accordingly, in the ink drying step OP2, the solvent contained in the ink 30 is evaporated to increase the viscosity of the ink 30.

In the ink drying step OP2, the solvent contained in the ink 30 is evaporated by sending air to the ink 30 deposited on the printing plate 1, or by applying heat to the printing plate 1. Alternatively, as illustrated in FIGS. 2(*b*) and 3(*c*), for example, the ink 30 may be dried naturally for a predetermined amount of time while keeping the printing plate 1 placed on the setting base B. The solvent has a higher volatility than other components contained in the ink 30. By evaporating the solvent away from the ink 30 by sending air to the ink 30 or other methods, the proportion of other components in the ink is increased to thereby increase the viscosity of the ink. At the completion of the ink drying step OP2, the ink has been adjusted to a viscosity ranging from 300 P (poise) and 1000 P (poise). Desirably, the amount of time for which to dry the ink is suitably adapted to the amount of time required for the transferring step OP3 and the printing step OP4 that are performed after the ink drying step OP2. This configuration allows a large number of print media 2 or 20 to be printed consecutively with efficiency.

In proceeding from the printing-plate making step OP1 to the ink drying step OP2, the printing plate 1 on the setting base B may be moved away from the setting base B or may remain placed on the setting base B. Moving the printing plate 1 away from the setting base B has the advantage of reducing the cycle time of the overall offsetting printing process as this allows another printing plate 1 to be immediately placed on the setting base B to start the printing-plate making step OP1.

The ink 30 on the printing plate 1 is died by, for example, placing an air-sending device and a heater beside the head of the ink-jet printing device 3, and sending air that has passed through the heater onto the printing plate 1 with the air-sending device. The heater placed together with the air-sending device is set to the highest possible temperature below the boiling point of the solvent contained in the ink 30. As the solvent contained in the ink 30, a solvent that does not dry in the head portion of the ink-jet printing device 3 and semi-dries in the ink drying step OP2 is selected. For example, a solvent with a flash point of 40 degrees C. or higher and a boiling point of 120 degrees C. or higher is selected. At this time, the heater placed beside the head of the ink-jet printing device 3 is set to a temperature of, for example, 100 degrees C. To make the viscosity of the ink 30 after completion of the ink drying step OP2 more stable, it is desirable to adjust the content of a photopolymer and a photoinitiator in the ink 30 such that their proportion ranges from one-third to one-half of the total ink 30. A solvent with low solvency is desired because a solvent with high solvency causes damage to the header of the ink-jet printing device 3. It is to be noted, however, the ink 30 used in the present invention is not limited to those mentioned above.

(Transferring Step OP3)

As illustrated in FIG. 2(*c*), in the transferring step OP3, the printing blanket 5 having a cylindrical shape is rolled on the printing plate 1. The ink 30 placed on the printing plate 1 is thus transferred to the surface of the printing blanket 5. If printing is performed by using the printing blanket 50 having a curved surface with a parabolic shape or other such shape as illustrated in FIG. 3(*c*), a print image is transferred by pressing the printing blanket 50 against the printing plate 1 from the apex of the printing blanket 50.

(Printing Step OP4)

As illustrated in FIG. 2(*d*), in the printing step OP4, the printing blanket 5 is rolled on the surface of the print medium 2 having a flat shape or a nearly flat curved surface. The ink 30 deposited on the surface of the printing blanket 5 is thus transferred to the surface of the print medium 2. If printing is performed by using the printing blanket 50 having a curved surface with a parabolic shape or other such shape as illustrated in FIG. 3(*d*), the printing blanket 50 is pressed against the surface of the print medium 20 from the apex of the printing blanket 50. The ink 30 deposited on the surface of the printing blanket 50 is thus transferred to the surface of the print medium 20. If the printing blanket 50 is used for printing, printing can be performed even on the print medium 20 having a curved surface as the printing blanket 50 conforms to the shape of the surface of the print medium 20.

(Fixing Step OP5)

As illustrated in FIG. 2(*e*), in the fixing step OP5, the ink 30 transferred to the surface of the print medium 20 in the printing step OP4 is fixed onto the surface. If UV ink is used as the ink 30, the ink 30 is cured at this time by irradiating the surface of the print medium 20 with ultraviolet light by using an ultraviolet irradiation device 6. Alternatively, electron beam irradiation may be employed instead of ultraviolet irradiation. As illustrated in FIG. 3(*e*), if the print medium 20 has a curved surface, it is desirable to use an ultraviolet irradiation device 60 capable of applying ultraviolet light in a manner that conforms to the curved surface of the print medium 20.

In the fixing step OP5, the ink 30 may not necessarily be cured by ultraviolet or electron beam irradiation. Alternatively, for example, the ink 30 may be cured by a method such as applying heat to the ink 30 by a heater, or drying the ink 30 by sending air to the ink 30. Further, the ink 30 may be cured by natural drying.

(Advantageous Effects of Embodiment 1)

Figure 4:
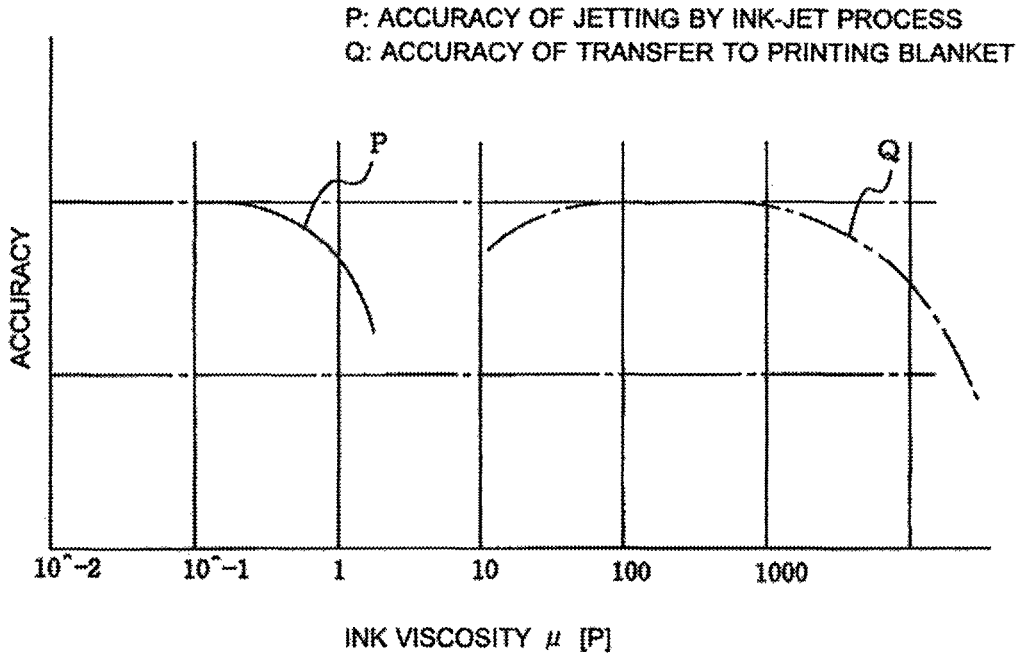
FIG. 4 illustrates adaptability to an ink-jet process (accuracy of ink jetting) with respect to ink viscosity, and the efficiency of transfer to the printing blanket (transfer accuracy) with respect to ink viscosity.

FIG. 4 illustrates adaptability to an ink-jet process with respect to the viscosity of the ink 30 (accuracy of ink jetting), and the efficiency of transfer to the printing blanket (transfer accuracy) with respect to ink viscosity. In FIG. 4, the horizontal axis is scaled logarithmically. The adaptability to an ink-jet process with respect to the viscosity of the ink 30 represents the accuracy of a print image printed by an ink-jet process as compared with an image input to a computer. The efficiency of transfer to the printing blanket with respect to the viscosity of the ink 30 represents the accuracy of an image transferred to a planar blanket made of silicone rubber, as compared with an image printed on the printing plate 1.

In FIG. 4, a curved line P represents the relationship between ink viscosity and jetting precision (accuracy) in an ink-jet process, and a curved line B represents the relationship between ink viscosity and the efficiency (accuracy) of transfer to the printing blanket. The appropriate viscosity range for the latter is higher than the appropriate viscosity range for the former. For this reason, in Embodiment 1, subsequent to printing on the printing plate 1 by an ink-jet process, rather than keeping the viscosity of the ink 30 low, the ink 30 is adjusted to an increased viscosity by evaporating the solvent contained in the ink 30. This allows for increased precision of a print image in the printing-plate making step OP1 printed by an ink-jet process, and also increased precision of the print image transferred from the printing plate 1 to the printing blanket 5 or 50 in the transferring step OP3. The appropriate viscosity range for the latter step is $10^2$ to $10^4$ times greater than the appropriate viscosity range for the former step. Thus, as the appropriate viscosity range for the latter step, a wide range of values can be used in comparison to the former step. Accordingly, the ink 30 used in Embodiment 1 is first adjusted to a viscosity suited for an ink-jet process. Then, the condition for drying the ink 30 in the ink drying step OP2 is adjusted as appropriate to ensure an appropriate level of accuracy of transfer from the printing plate 1 to the printing blanket 5 or 50.

In related art, in the ink drying step OP2, the ink 30 is irradiated with ultraviolet light. At this time, the irradiation condition is adjusted to obtain a viscosity of the ink 30 that ensures an appropriate level of accuracy of transfer to the printing blanket 5 or 50. For this reason, the ink 30 used for printing needs to be an UV ink with a comparatively long curing time. A potential problem with the above-mentioned approach, which uses UV ink and adjusts the irradiation condition to adjust the viscosity of the ink 30, is that due to the difficulty of adjusting the irradiation condition, only the surface of the ink 30 is cured by ultraviolet irradiation, resulting in uneven hardness of the ink. This makes it impossible to ensure an appropriate level of accuracy of transfer to the printing blanket 50. By contrast, with the offset printing method according to Embodiment 1, the viscosity of the ink 30 is adjusted in the ink drying step OP2 by evaporation of the solvent contained in the ink 30 without performing ultraviolet irradiation. Thus, unlike with related art, the ink 30 used for printing does not need to be an UV ink with a long curing time. For example, it is possible to use an UV ink with a short curing time as the ink 30 used for printing, carry out the steps from OP1 to OP4, and perform ultraviolet irradiation in the fixing step OP5 to reduce the time required for the fixing step OP5.

Further, with the offset printing method according to Embodiment 1, a solvent is added to the ink 30 used for printing, and the viscosity of the resulting ink 30 is adjusted. This allows use of various types of ink in performing printing on the printing plate 1 by an ink-jet process. The printing plate 1 is machined to a predetermined surface roughness that allows for sufficient print precision without repelling droplets of the ink 30 having a low viscosity. As for the specifications for the printing plate 1, reference can be made to Japanese Unexamined Patent Application Publication No. 10-235989 "Method for offset printing by ink-jet process" previously filed by the present applicant.

| Reference Signs List | |
|---|---|
| 1 | printing plate |
| 2 | print medium |
| 3 | ink-jet printing device |
| 5 | printing blanket |
| 6 | ultraviolet irradiation device |
| 20 | print medium |
| 30 | ink |
| 50 | printing blanket |
| 60 | ultraviolet irradiation device |
| B | setting base |
| OP1 | printing-plate making step |
| OP2 | ink drying step |
| OP3 | transferring step |
| OP4 | printing step |
| OP5 | fixing step |

The invention claimed is:

1. An offset printing method comprising:

a printing-plate making step of printing an inked image on a printing plate by an ink-jet process;

an ink drying step of evaporating a solvent contained in an ink of the inked image to increase a viscosity of the ink;

a transferring step of transferring the inked image to a surface of a printing blanket; and a printing step of pressing the printing blanket against a print medium, wherein the ink drying step includes a step of sending air directly toward the ink on the printing plate, and wherein in the printing-plate making step, the printing plate has a surface roughness ranging from 2 μm to 10 μm.

2. The offset printing method of claim 1, wherein the ink drying step includes a step of heating the printing plate.

3. The offset printing method of claim 1, wherein the ink drying step includes heating air sent to the printing plate to a temperature, the temperature being higher than or equal to a flash point of the solvent contained in the ink and lower than or equal to a boiling point of the solvent.

4. The offset printing method of claim 1, wherein in the printing-plate making step, the ink includes a photopolymer and a photoinitiator that are contained in a proportion ranging from one-third to one-half of a total composition of the ink.

5. An offset printing method comprising:

a printing-plate making step of printing an inked image on a printing plate by an ink-jet process;

an ink drying step of evaporating a solvent contained in an ink of the inked image to increase a viscosity of the ink;

a transferring step of transferring the inked image to a surface of a printing blanket; and a printing step of pressing the printing blanket against a print medium, wherein the ink drying step includes a step of sending air directly toward the ink on the printing plate, and wherein in the printing-plate making step, the ink has a viscosity ranging from 1 mP (poise) to 10 mP (poise).

6. An offset printing method comprising:

a printing-plate making step of printing an inked image on a printing plate by an ink-jet process;

an ink drying step of evaporating a solvent contained in an ink of the inked image to increase a viscosity of the ink;

a transferring step of transferring the inked image to a surface of a printing blanket; and a printing step of pressing the printing blanket against a print medium, wherein the ink drying step includes a step of sending air directly toward the ink on the printing plate, and wherein in the printing-plate making step, the ink has a viscosity ranging from 300 P (poise) to 1000 P (poise).

7. The offset printing method of claim 1, further comprising a fixing step of fixing the printed inked image onto the print medium.

8. The offset printing method of claim 7, wherein the fixing step includes a step of irradiating the print medium with ultraviolet light.

9. The offset printing method of claim 7, wherein the fixing step includes a step of sending air toward the print medium.

10. The offset printing method of claim 7, wherein the fixing step includes a step of heating the print medium.

11. The offset printing method of claim 5, wherein in the printing-plate making step, the printing plate has a surface roughness ranging from 2 μm to 10 μm.

12. The offset printing method of claim 1, wherein the printing plate making step of printing an inked image on a printing plate by an ink-jet process comprises disposing the printing plate under a head of an ink-jet printing device and moving the printing plate and head relative to one another, and wherein the ink drying step comprises sending the air toward the ink on the printing plate from an air-sending device disposed adjacent the head of the ink-jet printing device.

* * * * *